US005946533A

United States Patent [19]

Omelchenko et al.

[11] Patent Number: 5,946,533

[45] Date of Patent: Aug. 31, 1999

[54] PRINTING MACHINE ARCHITECTURE

[75] Inventors: Mark A. Omelchenko, Lexington, Ky.; Daniel W. Costanza, Rochester, N.Y.; James M. Casella, Webster, N.Y.; Robert M. Lofthus, Honeoye Falls, N.Y.; Orlando J. Lacayo, Rochester, N.Y.; Michael F. Leo, Penfield, N.Y.; Michael J. Martin, Hamlin, N.Y.; Joseph M. Wing, Ontario, N.Y.; Ssujan Hou, Cheshire, Conn.; Michael R. Furst, Rochester; Mark A. Adiletta, Fairport, both of N.Y.

[73] Assignee: Xerox Corporation, Stamford, Conn.

[21] Appl. No.: 09/212,591

[22] Filed: Dec. 16, 1998

[51] Int. Cl.[6] ..... G03G 15/01

[52] U.S. Cl. ..... 399/223

[58] Field of Search ..... 399/223, 162, 399/302, 308, 309, 364

[56] References Cited

U.S. PATENT DOCUMENTS 4,998,145 3/1991 Haneda et al. ..... 355/327

5,270,769 12/1993 Satoh et al. ..... 355/272

5,313,259 5/1994 Smith ..... 355/326

*Primary Examiner*—William Royer

*Assistant Examiner*—Greg Moldafsky

*Attorney, Agent, or Firm*—H. Fleischer; J. E. Beck; B. P. Smith

[57] ABSTRACT

A single pass, multi-color electrophotographic printing machine architecture uses a vertically oriented photoconductive belt. Transfer of the toner powder images occur at the lowermost portion of the photoconductive belt. The photoconductive belt is elliptically shaped, having a major and a minor axis. N image recording stations are positioned adjacent an exterior surface of the photoconductive belt on one side of the major axis thereof. N−1 image recording stations are positioned adjacent the exterior surface of the photoconductive belt on the other side of the major axis thereof. The image recording stations record electrostatic latent images on the photoconductive belt. This architecture optimizes image registration while minimizing the overall height of the printing machine.

11 Claims, 1 Drawing Sheet

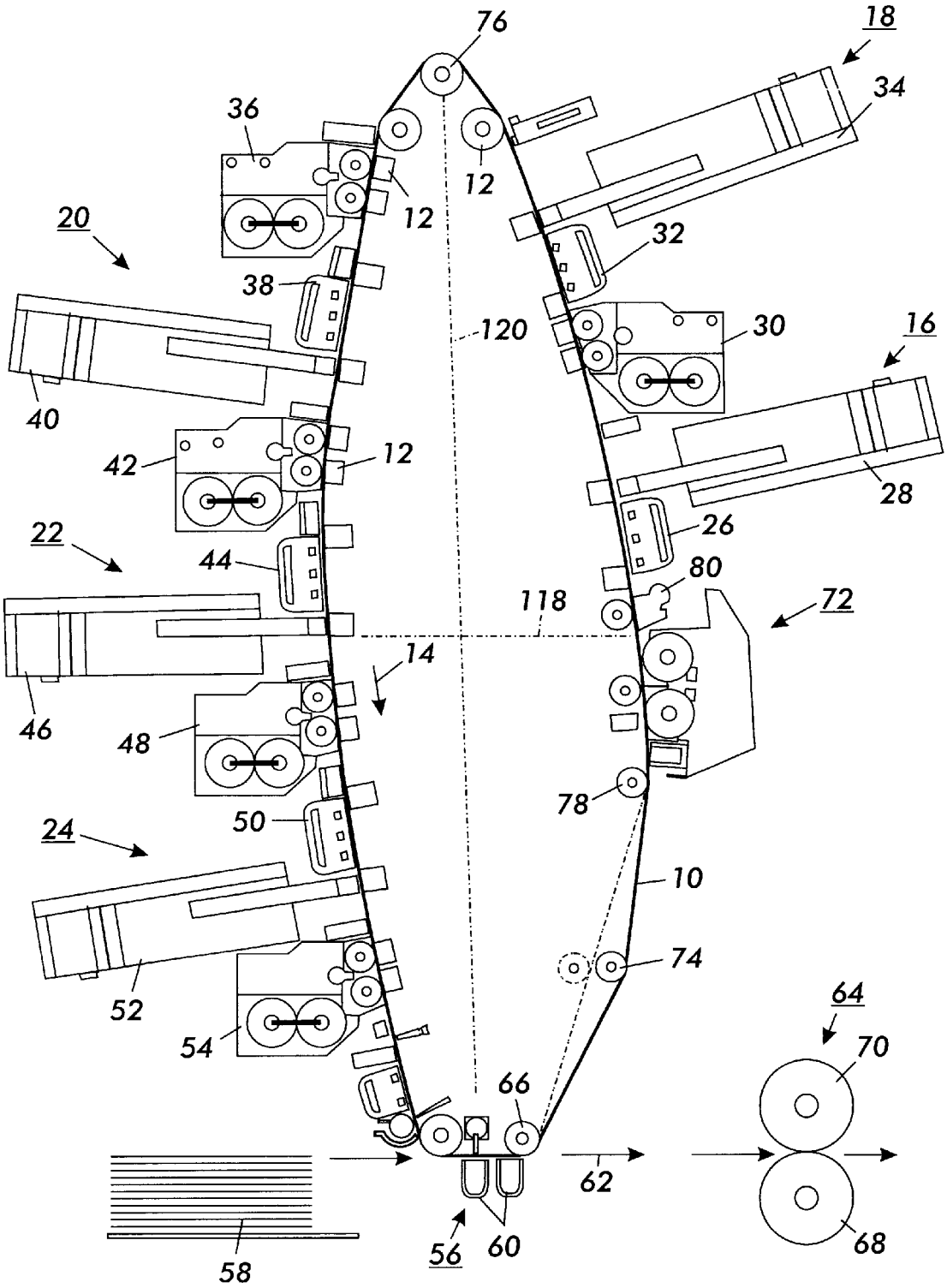
76
18
34
36
12
12
20
32
38
120
30
16
40
42
12
28
22
26
44
80
118
72
14
46
48
78
24
50
10
74
52
64
54
70
66
62
58
56
60
68

PRINTING MACHINE ARCHITECTURE

This invention relates to a printing machine architecture, and more particularly, concerns an elliptically shaped photoconductive belt having N image recording stations positioned adjacent an exterior surface of the photoconductive belt on one side of the major axis, and N−1 image recording stations positioned adjacent the exterior surface of the photoconductive belt on the other side of the major axis to record electrostatic latent images on the photoconductive belt.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrophotographic printing machine of this type to produce color prints. In order to produce a color print, the printing machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a sheet. The transferred multi-color image is then permanently fused to the sheet forming the color print. Hereinbefore, a color printing machine used four developer units. These developer units were all disposed on one side of the photoconductive belt with the other side thereof being devoid of developer units. A color printing machine of this type required an overly long photoconductive belt. A photoconductive belt of this type would require eleven, nine-inch pitches to operate at 100 ppm. A belt of this length will have very low yields when being made in large quantities. In addition, this results in an overly tall printing machine when the photoconductive belt is arranged with the major axis aligned vertically. The requirement of having all of the developer units or exposure stations on one side of the photoconductive belt is necessary in order to maintain image-on-image registration. Thus, it is highly desirable to reduce the overall height of the printing machine while still maintaining the required image-on-image registration.

Various types of multi-color printing machines have heretofore been employed. The following disclosures appear to be relevant:

U.S. Pat. No. 4,998,145

Patentee: Haneda, et al.

Issued: Mar. 5, 1991

U.S. Pat. No. 5,270,769

Patentee: Satoh, et al

Issued: Dec. 14, 1993

U.S. Pat. No. 5,313,259

Patentee: Smith

Issued: May 17, 1994

U.S. Pat. No. 4,998,145 discloses an electrophotographic printing machine having a plurality of developer units adjacent one another on one side of the diameter of a photoconductive drum.

U.S. Pat. No. 5,270,769 describes a printing machine having a plurality of developer units disposed on one side of a photoconductive belt. A cleaning unit is positioned on the other side of the photoconductive belt. Different colored developed images are transferred to an intermediate belt. The resultant composite multi-color image is then transferred from the intermediate belt to a sheet of support material and fused thereto. The photoconductive belt is arranged vertically.

U.S. Pat. No. 5,313,259 discloses a multi-color electrophotographic printing machine in which a photoconductive belt is vertically oriented. The machine includes four groups of stations for printing in cyan, magenta, yellow, and black. Each station includes a charged corona generator, a raster output scanning laser assembly, and a developer unit. These stations are positioned on one side of the photoconductive belt with the fourth station being disposed on the other side thereof. Successive different color toner particle images are formed in superimposed registration with one another on the photoconductive belt and transferred to a copy sheet simultaneously. Transfer occurs at the lowermost position of the photoconductive belt.

In accordance with one aspect of the features of the present invention, there is provided an electrophotographic printing machine including an elliptically shaped photoconductive belt having a major axis and a minor axis. N image recording stations are positioned on one side of the major axis and N−1 image recording stations are positioned adjacent the other side of the major axis to record electrostatic latent images on the photoconductive belt.

Other aspects of the present invention will become apparent as the following description proceeds and upon reference to the drawing, which is a schematic, elevational view showing a single pass multi-color printing machine architecture.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawing. In the drawing, like reference numerals have been used throughout to designate identical elements.

Referring now to the drawing, there is shown a single pass multi-color printing machine. This printing machine employs a photoconductive belt 10, supported by a plurality of rollers or bars, 12. Photoconductive belt 10 is arranged in a vertical orientation. Belt 10 advances in the direction of arrow 14 to move successive portions of the external surface of photoconductive belt 10 sequentially beneath the various processing stations disposed about the path of movement thereof. The photoconductive belt has a major axis 120 and a minor axis 118. The major and minor axes are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, belt 10 passes through image recording station 16. Image recording station 16 includes a charging device and an exposure device. The charging device includes including a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Cyan developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. The belt 10 then moves under spots blade 80 to also remove toner particles therefrom.

It has been determined that belt tensioning member 74, preferably a roll, which is resiliently urged into contact with the interior surface of photoconductive belt 10, has a large impact on image registration. Heretofore, tensioning of the photoconductive belt was achieved by a roll located in the position of steering roll 76. In printing machines of this type, the image recording stations were positioned on one side of the major axis, with at most there being one image recording device on the other side thereof. Thus, there would be an image recording device on one side of the major axis of the photoconductive belt, separated by the tensioning roll, followed by four image recording devices positioned on the other side of the major axis of photoconductive belt 10. It has been determined that when the height of the photoconductive belt is reduced, requiring two image recording stations to be positioned on one side of the major axis and three image recording stations to be positioned on the other side of the major axis, image-to-image registration deteriorated. This has been overcome by changing the location of the tensioning roll so as to position it between stripping roller 66 and isolation roll 78 adjacent cleaning station 72. This configuration enabled image-on-image registration to be maintained at the same levels as a printing machine of the previous type, provided that the tensioning mechanism was interposed between stripper roller 66 isolation roll 78. Tensioning roll 74 is mounted slidably on brackets. A spring resiliently urges tensioning roll 74 into contact with the interior surface of photoconductive belt 10 to maintain belt 10 at the appropriate tension.

In recapitulation, it is clear that the present invention is directed to a printing machine architecture having N image recording stations positioned adjacent an exterior surface of the photoconductive belt on one side of the major axis thereof and N−1 image recording stations positioned adjacent an exterior surface of the photoconductive belt on the other side of the major axis. These imaging stations record electrostatic latent images on the photoconductive belt.

It is, therefore, apparent that there has been provided in accordance with the present invention, a printing machine architecture which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An electrophotographic printing machine, including:

an elliptically shaped photoconductive belt having a major axis and a minor axis;

N image recording stations positioned adjacent an exterior surface of said photoconductive belt on one side of the major axis thereof, whereby N is greater than one; and N−1 image recording stations positioned adjacent the exterior surface of said photoconductive belt on the other side of the major axis to record electrostatic latent images on said photoconductive belt.

2. A printing machine according to claim 1, further including a plurality of developer units, with one of said plurality of developer units being positioned between adjacent said image recording stations, to develop the electrostatic latent images recorded on said photoconductive belt with different color toner to form a developed image on the exterior surface of said photoconductive belt.

3. A printing machine according to claim 2, further including a transfer station, positioned adjacent said photoconductive belt, to transfer the developed image from said photoconductive belt to a receiving medium.

4. A printing machine according to claim 3, further including a cleaning station, positioned adjacent said photoconductive belt, to remove material therefrom after said transfer station transfers the developed image to the receiving medium.

5. A printing machine according to claim 4, further including a tensioning member, positioned between said transfer station and said cleaning station and contacting an interior surface of said photoconductive belt, to maintain said photoconductive belt in tension.

6. A printing machine according to claim 5, further including an isolation member contacting the interior surface of said photoconductor belt adjacent said cleaning station between said tensioning member and said cleaning station.

7. A printing machine according to claim 6, wherein each of said image recording stations includes:

a charging device, located adjacent said photoconductive belt, for charging the exterior surface of said photoconductive belt; and an exposure device for illuminating selected areas of the charged exterior surface of said photoconductive belt so as to discharge selected portions of the charged exterior surface of said photoconductive belt to record the electrostatic latent images thereon.

8. A printing machine according to claim 7, wherein said charging device includes a charging corona generator.

9. A printing machine according to claim 8, wherein said transfer station includes:

a transfer corona generator positioned adjacent the exterior surface of said photoconductive belt; and a stripping member, positioned in contact with the interior surface of said photoconductive belt between said transfer corona generator and said tensioning member.

10. A printing machine according to claim 9, wherein said photoconductive belt moves in a recirculating path.

11. A printing machine according to claim 10, further including a fusing station, operatively associated with the receiving member, to fix the image transferred to the receiving member.

* * * * *